United States Patent [19]

Dollman

[11] 4,435,223

[45] Mar. 6, 1984

[54] NON-FLUORIDE ACID COMPOSITIONS FOR CLEANING ALUMINUM SURFACES

[75] Inventor: David Y. Dollman, Doylestown, Pa.

[73] Assignee: Amchem Products, Inc., Ambler, Pa.

[21] Appl. No.: 378,749

[22] Filed: May 18, 1982

Related U.S. Application Data

[63] Continuation-in-part of Ser. No. 277,560, Jun. 24, 1981, abandoned.

[51] Int. Cl.[3] ..... C11D 1/66; C11D 3/04; C11D 7/08; C23G 1/12

[52] U.S. Cl. ..... 134/3; 134/40; 134/41; 252/136; 252/142

[58] Field of Search ..... 134/3, 26, 28, 40, 41; 148/6.27, 6.17; 156/665; 252/80, 87, 136, 142

[56] References Cited

U.S. PATENT DOCUMENTS

| | | | |
|---|---|---|---|
| Re. 27,662 | 6/1973 | Hamilton | 156/664 |
| 2,650,156 | 8/1953 | Jones | 134/3 |
| 2,662,814 | 12/1953 | Swihart | 156/664 |
| 3,575,747 | 4/1971 | Cohn | 156/19 |
| 3,635,826 | 1/1972 | Hamilton | 252/79.4 |
| 3,969,135 | 7/1976 | King et al. | 134/41 |
| 4,009,115 | 2/1977 | Binns | 252/142 |
| 4,116,853 | 9/1978 | Binns | 252/142 |
| 4,124,407 | 11/1978 | Binns | 134/3 |

OTHER PUBLICATIONS

McCutcheon's Detergents & Emulsifiers–1978 Annual, M. C. Publishing Co., Glen Rock, New Jersey, p. 251.

*Primary Examiner*—Dennis L. Albrecht
*Attorney, Agent, or Firm*—Ernest G. Szoke; Henry E. Millson, Jr.

[57] ABSTRACT

Compositions and methods for cleaning aluminum surfaces wherein the cleaning compositions contain sulfuric acid, phosphoric acid, and at least one surfactant.

14 Claims, No Drawings

NON-FLUORIDE ACID COMPOSITIONS FOR CLEANING ALUMINUM SURFACES

This application is a continuation-in-part of U.S. application Ser. No. 277,560, filed June 24, 1981 in favor of David Y. Dollman, now abandoned.

BACKGROUND OF THE INVENTION

Containers of aluminum and aluminum alloys are manufactured by a drawing and forming operation, commonly referred to as drawing and ironing. This operation results in the deposition of lubricants and forming oils on the surfaces of the containers. In addition, residual aluminum fines are deposited on the surfaces, with relatively larger quantities present on the inside surface of the container.

Prior to processing the containers, e.g. conversion coating and sanitary lacquer deposition, the surfaces of the containers must be clean and free of water breaks, so that no contaminants remain on the surfaces which will interfere with further processing of the containers.

Compositions currently used commercially for cleaning such aluminum containers are aqueous sulfuric acid solutions containing hydrofluoric acid and one or more surfactants. Such cleaning solutions are quite effective and have many advantages. However, there are also some disadvantages associated with such cleaning compositions. For example, fluoride containing compositions are capable of dissolving stainless steel and other iron alloy equipment commonly utilized in the container cleaning lines. Also, hydrofluoric acid and fluorides present in spent cleaning baths and rinse water present an environmental problem in their disposition.

Compositions and methods for the low temperature cleaning of aluminum surfaces are disclosed in U.S. Pat. No. 4,009,115 issued Feb. 22, 1977 to Robert Eric Binns, U.S. Pat. No. 4,116,853 issued Sept. 26, 1978 to Robert Eric Binns, U.S. Pat. No. 4,124,407 issued Nov. 7, 1978 to Robert Eric Binns, and U.S. Pat. No. 3,969,135 issued July 13, 1976 to Peter F. King, et al. These patents disclose cleaning compositions containing sulfuric acid, hydrofluoric acid or a fluoride salt, and a surfactant.

Compositions and methods for the high temperature cleaning of aluminum surfaces are disclosed in many patents, a typical example of which is U.S. Pat. No. 3,635,826 issued Jan. 18, 1972 to Andrew J. Hamilton. Such high temperature compositions and processes are now seldom used due to escalating costs of energy.

DETAILED DESCRIPTION OF THE INVENTION

There has now been discovered compositions and methods for the acid cleaning of aluminum surfaces at relatively low temperatures wherein the compositions are free of hydrofluoric acid and other fluorides.

The aqueous cleaning solutions of the invention contain the following ingredients in the following concentrations:

| | Ingredient | Grams/Liter of Solution |
|---|---|---|
| 1. | $H_3PO_4$ (100%) | about 3 to about 22, preferably about 9 to about 22, and more preferably about 10 to about 20. |
| 2. | $H_2SO_4$ (100%) | about 4 to about 24, preferably about 6 to about 15. |
| 3. | Surfactant | about 0.1 to about 7.5, preferably about 0.5 to about 2. |

While the above broad range for the concentration of phosphoric acid in the present aqueous cleaning solution includes quantities as low as 3 g/l, it should be understood that concentrations below the lower limit of the preferred range, i.e. concentrations of phosphoric acid between about 3 and about 9 g/l do not consistently produce cleaning solutions that are operable at all commercial line speeds and operating temperatures, and are therefore not always useful in the practice of the invention. Hence, the preferred range for phosphoric acid of about 9 to about 22 g/l is actually highly preferred in order to produce a commercially useful cleaning solution that can be used over a wide range of operating conditions set forth hereinafter for the process of the invention.

With respect to the surfactant used in these aqueous cleaning solutions, the surfactant can be anionic, cationic, or non-ionic.

Examples of surface active agents that can be utilized are:

TERGITOL ANIONIC-08 (Union Carbide Corporation) an anionic surfactant believed to be sodium 2-ethyl hexyl sulfate;

TRITON DF-16 (Rohm & Haas Co.) a nonionic surfactant believed to be a modified polyethoxylated straight chain alcohol;

POLYTERGENT S-505LF (Olin Corp.) a nonionic surfactant believed to be a modified polyethoxylated straight chain alcohol;

SURFONIC LF-17 (Jefferson Chemical Co.) a nonionic surfactant believed to be an alkyl polyethoxylated ether;

PLURAFAC RA-30 (BASF Wyandotte Corp.) a nonionic surfactant, believed to be a modified oxyethylated straight chain alcohol;

PLURAFAC D-25 (BASF Wyandotte Corp.) a nonionic surfactant believed to be a modified oxyethylated straight chain alcohol;

TRITON X-102 (Rohm & Haas Co.) a nonionic surfactant believed to be an octyl phenoxy polyethoxy ethanol;

ANTAROX BL 330 (GAF Corp.) a nonionic surfactant believed to be an alkyl poly(ethyleneoxy)ethanol;

TRITON CF-10 (Rohm & Haas Co.) a nonionic surfactant, and believed to be an alkylaryl polyether having a carbon chain of about 14 carbon atoms and approximately 16 moles of ethoxylation;

SURFACTANT AR150 (Hercules, Inc.) a nonionic surfactant, and believed to be an ethoxylated abietic acid derivative with approximately 15 moles of ethoxylation;

PLURONIC LO61 (BASF Wyandotte, Inc.) a nonionic surfactant, and believed to be a condensate containing only ethylene oxide and propylene oxide chains;

ANTAROX LF-330 (GAF Corp.) a nonionic surfactant, believed to be an alkyl poly(ethyleneoxy)ethanol;

PEGOSPERSE 700-TO (Glyco Chemicals, Inc.) a nonionic surfactant, and believed to be an abietic acid ester containing approximately 14 to 16 moles of ethoxylation;

IGEPAL CA-630 (GAF Corp.) a nonionic surfactant, believed to be an alkyl phenoxy poly(ethyleneoxy)ethanol;

TRYCOL LF-1 (Emery Industries, Inc.) a nonionic surfactant believed to be an alkyl polyether; and RENEX 20 (I.C.I. United States, Inc.) a nonionic polyoxyethylene ester of mixed fatty acids and resin acids.

The surfactant used in the present aqueous cleaning solutions can also be a combination of two or more surfactants. In fact, it is preferred to employ in the cleaning solutions a combination of (i) from about 0.25 to about 1.0, preferably about 0.40 to about 0.80 g/l of a high detergency surfactant, and (ii) from about 0.25 to about 1.0, preferably from about 0.40 to about 0.75 g/l of a low foaming surfactant.

The high detergency surfactant used in the above preferred combination of surfactants can be any anionic, cationic or nonionic surfactant that gives a result of at least 90% on stainless steel in the Hard-Surface Cleaning Test (M. N. Fineman, ASTM Bulletin No. 192, pages 49–55, Sept. 1953). Examples of such high detergency surfactants are PLURAFAC RA-30, PLURAFAC D-25, TRITON X-102, SURFACTANT AR150 and IGEPAL CA-630.

The low foaming surfactant used in the above preferred combination of surfactants can be any anionic, cationic or nonionic surfactant that gives less than 20 mm. of foam after five minutes standing in the well known Ross-Miles Foam Test at 50° C. Examples of such low foaming surfactants are TRITON DF-16, POLYTERGENT S-505, SURFONIC LF-17, ANTAROX BL330, TRITON CF-10, PLURONIC LO61, ANTAROX LF-330, MIRAWET B (Miranol Chemical Co.) which is sodium 2-butoxyethoxyacetate, and MIN-FOAM 1X (Union Carbode Corp.) a nonionic surfactant believed to be alkyloxy(polyethyleneoxypropyleneoxyisopropanol) having a molecular weight of about 706.

In the event a particular surfactant alone meets both the high detergency and low foaming criteria of the preferred surfactant combination, such surfactant can be employed alone in quantities of from about 0.5 to about 2.0 g/l and still fall within this preferred embodiment of the invention.

It is understood that while the quantities of phosphoric and sulfuric acids used to form the aqueous cleaning solution of the invention are given as 100% acid, they are conveniently and usually added to form the concentrates and baths of the present invention in their common commercial forms, such as 75% $H_3PO_4$ and 66° Baumé $H_2SO_4$.

The cleaning solutions of the invention are conveniently formed by diluting in water a concentrated composition containing the ingredients. The concentrated compositions which can be employed for this purpose, and which comprise part of the present invention, contain the above ingredients in concentrated aqueous solution. Each ingredient is present in the concentrate in quantity sufficient to provide the required amounts in the cleaning solutions that result when the concentrate is diluted with a controlled quantity of water.

The concentrates of the invention are stable under a wide range of temperatures, and hence can be shipped and stored even under extreme winter and summer temperatures. Furthermore, the concentrates of the invention can contain all of the ingredients needed to form the cleaning solution, unlike the fluoride-containing cleaning solutions, where the addition of hydrofluoric acid to the concentrate is impractical. The hydrofluoric acid component used in these prior art processes usually must be separately added under controlled, metered conditions, leading to an extra step and expense in forming the cleaning solution.

The processes of the present invention comprise contacting the aluminum or aluminum alloy surfaces to be cleaned with the aqueous cleaning solutions of the invention, using any of the contacting techniques known to the art, such as conventional spray or immersion methods. The temperature of the cleaning solution is preferably maintained in the range of from about 115° F. to about 140° F., although temperatures as low as about 90° F. can be employed. Treatment times with the cleaning solutions are usually of the order of about 10 seconds to about 2 minutes, preferably about 30 seconds to about 1 minute.

Following the cleaning step, the aluminum surfaces are rinsed with water to remove the cleaning solution. The aluminum surface may then be treated with coating solutions or siccative finish coating compositions well known to the art. Also, pre-rinse of the sluminum surfaces with water prior to the cleaning step is sometimes beneficial in reducing the amount of contaminants that would otherwise enter the cleaning bath.

Using the cleaning solutions of the present invention in the processes of the present invention results in a number of useful advantages. For example, as stated above, the present compositions do not contain fluorides, which have problems involving handling, attack of metal equipment, and disposal.

The present processes are relatively low temperature processes, resulting in decreased operating expense and fuel conservation.

Also, the present compositions produce aluminum surfaces having unusually high gloss, a distinct advantage to certain container customers where a frosty appearance will show through their labeling on the containers. The present compositions produce this superior gloss by having a lower aluminum dissolution rate compared to fluoride-containing prior art compositions.

Furthermore, the present compositions produce cleaned aluminum cans that are free of dome staining.

In addition, the compositions of the invention provide excellent lubricating oil removing capability, resulting in aluminum containers that are free of water breaks.

Another advantage of the present compositions is that no sludging forms in the cleaning baths, since the present compositions maintain dissolved aluminum in the solution. Also, no precipitates form in the rinse water tanks, eliminating the problems of scaling that often results when prior art compositions are employed.

The following examples are illustrative of the invention and are not meant to limit it.

EXAMPLE I

A liter of aqueous concentrate was prepared containing the following ingredients and quantities:

| Ingredient | Quantity |
|---|---|
| $H_2SO_4$ (66° Baumé) | 243.9 g |
| $H_3PO_4$ (75%) | 708 g |
| Surfactant AR-150 | 20.3 g |

-continued

| Ingredient | Quantity |
|---|---|
| Surfonic LF-17 | 13.0 g |
| Water | q.s. |

The above concentrate was clear and stable.

The concentrate was added to water at the ratio of 3% concentrate/97% water, and the resulting solution stirred to render it uniform.

The resulting cleaning solution had the following composition:

| | |
|---|---|
| $H_2SO_4$ (100%) | 7.03 g/l |
| $H_3PO_4$ (100%) | 15.94 g/l |
| Surfactant AR-150 | 0.61 g/l |
| Surfonic LF-17 | 0.39 g/l |

Aluminum cans of 3004 alloy drawn into single piece containers were employed in this procedure. The cans were covered with drawing oils.

Five test specimens were treated as follows:

(a) Sprayed for 20 seconds with the above cleaning solution maintained at 130° F., (b) Rinsed with water by immersion in cold water for 30 seconds, and (c) Allowed to stand for 30 seconds, after which they were examined for appearance and for water breaks on both the inside and outside.

The cans were completely free of water breaks and exhibited a very high gloss, without any frosting, and were suitable for further commercial processing. An average of 5.5 mgs. of aluminum has been dissolved from the surfaces of each can, each of which has about 120 sq. inches of surface area.

An additional five cans were processed as above, except that the spray time in step (a) was 40 seconds. The same results were obtained, except that an average of 6.2 mgs. of aluminum was dissolved from the surfaces of each can.

A further five cans were processed as above, except that the spray time in step (a) was 60 seconds, producing the same results except for an average aluminum dissolution value of 11.1 mgs.

EXAMPLE II

The same concentrate as was used in EXAMPLE I was added to water at the ratio of 4% concentrate/96% water, and the resulting solution stirred to render it uniform.

The resulting cleaning solution had the following composition:

| | |
|---|---|
| $H_2SO_4$ (100%) | 9.37 g/l |
| $H_3PO_4$ (100%) | 21.25 g/l |
| Surfactant AR-150 | 0.81 g/l |
| Surfonic LF-17 | 0.52 g/l |

Aluminum cans were treated according to the process of EXAMPLE I using the above cleaning solution. The cans were completely free of water breaks, and had a very high gloss, without any frosting. The cans were suitable for further commercial processing.

The average aluminum dissolution results were as follows:

| Spray time, secs. | Aluminum dissolution, mgs. |
|---|---|
| 20 | 6.1 |
| 40 | 8.0 |
| 60 | 11.1 |

EXAMPLE III

One thousand gallons of cleaning solution was prepared containing the following ingredients and concentrations:

| Ingredient | Grams/Liter |
|---|---|
| $H_2SO_4$ (66° Baume) | 12.4 |
| $H_3PO_4$ (75%) | 13.6 |
| Surfactant AR-150 | 0.82 |
| Surfonic LF-17 | 0.52 |

One thousand aluminum cans of 3004 alloy drawn into single piece containers, and covered with drawing oils, were processed in a commercial cleaning line using the following procedure:

(a) Sprayed for 22 seconds with the above cleaning solution maintained at 136° F., (b) Rinsed with cold water by spraying for 10 seconds, (c) Sprayed with a standard chemical conversion coating solution—an aqueous solution of ALODINE 404 (2% by volume) at 100° F. for about 20 seconds to deposit a phosphate conversion coating on the cans, (d) Rinsed with cold water by spraying for 10 seconds, (e) Rinsed with deionized water by spraying for 10 seconds, (f) Dried in an oven at about 300° F., and (g) The cans were then inked (labeled) on the outside and lacquered on the inside.

Samples of the processed cans were tested according to a standard industry adhesion detergent test (TR-4 Test). All of the cans passed this test, showing their suitability for commercial purposes.

Furthermore, the cans were bright with a high gloss, and no frosty appearance showed through the labeling.

EXAMPLE IV

A cleaning solution was prepared having the following composition:

| | |
|---|---|
| $H_2SO_4$ (100%) | 4.39 g/l |
| $H_3PO_4$ (100%) | 15.94 g/l |
| Plurafac D-25 | 0.61 g/l |
| Triton DF-16 | 0.39 g/l |

Aluminum cans of 3004 alloy and covered with drawing oils were treated with the above bath using the process of EXAMPLE I except that the spray times and temperatures for the cleaning solution spray (step (a)) are given below, together with the resulting aluminum dissolution results:

| Spray time, secs. | Spray temp., °F. | Al. dissolution, mgs. |
|---|---|---|
| 20 | 130 | 5.87 |
| 60 | 130 | 10.07 |
| 20 | 140 | 6.97 |

-continued

| Spray time, secs. | Spray temp., °F. | Al. dissolution, mgs. |
|---|---|---|
| 60 | 140 | 12.20 |

The cans were completely free of water breaks, with a high gloss and absence of frosting. The cans were suitable for further commercial processing.

What is claimed is:

1. A process for cleaning an aluminum based surface comprising the steps of (a) contacting said surface with an aqueous cleaning solution which is free of hydrofluoric acid and other fluorides and which comprises from about 4 to about 24 grams/liter of sulfuric acid, from about 9 to about 22 grams/liter of orthophosphoric acid, and from about 0.1 to about 7.5 grams/liter of a surfactant at a temperature in the range of from about 90° F. to about 140° F. and a treatment time of from about 10 seconds to about 1 minute, and (b) rinsing the aluminum based surface to remove the cleaning solution therefrom.

2. A process in accordance with claim 1 wherein in step (a) the surfactant is a combination of from about 0.25 to about 1.0 grams/liter of a high detergency surfactant, and from about 0.25 to about 1.0 grams/liter of a low foaming surfactant, and where a surfactant is both a high detergency surfactant and a low foaming surfactant, then such surfactant is employed alone in a quantity of from about 0.5 to about 2.0 grams/liter.

3. A process in accordance with claim 1 wherein the sulfuric acid in step (a) is present in from about 6 to about 15 grams/liter.

4. A process in accordance with claim 1 wherein the phosphoric acid in step (a) is present in from about 10 to about 20 grams/liter.

5. A process in accordance with claim 2 wherein the high detergency surfactant in step (a) is present in from about 0.40 to about 0.80 grams/liter.

6. A process in accordance with claim 2 wherein the low foaming surfactant in step (a) is present in from about 0.40 to about 0.75 grams/liter.

7. A process in accordance with claim 2 wherein the high detergency surfactant in step (a) gives a result of at least 90% in the Hard-Surface Cleaning Test on stainless steel.

8. A process in accordance with claim 2 wherein the low foaming surfactant in step (a) has less than 20 mm. of foam after five minutes standing in the Ross-Miles Foam Test at 50° C.

9. A process in accordance with claim 2 wherein the high detergency surfactant in step (a) is an ethoxylated abietic acid derivative with approximately 15 moles of ethoxylation.

10. A process in accordance with claim 2 wherein the low foaming surfactant in step (a) is an alkyl polyethoxylated ether.

11. A process in accordance with claim 1 wherein the treatment time in step (a) is from about 30 seconds to about 1 minute.

12. A process in accordance with claim 1 wherein the aluminum based surface is contacted with the aqueous cleaning solution by spraying said solution onto the surface.

13. A process in accordance with claim 1 wherein the solution temperature is maintained in the range of from about 115° F. to about 140° F.

14. A process in accordance with claim 1 wherein the aluminum based surface is the surface of an aluminum based can.

* * * * *